US008127894B2

(12) United States Patent
Agirman et al.

(10) Patent No.: US 8,127,894 B2
(45) Date of Patent: Mar. 6, 2012

(54) ELEVATOR MOTOR DRIVE TOLERANT OF AN IRREGULAR POWER SOURCE

(75) Inventors: Ismail Agirman, Farmington, CT (US); Christopher S. Czerwinski, Farmington, CT (US); Jeffrey M. Izard, Bolton, CT (US); Edward D. Piedra, Holyoke, MA (US); Vladimir Blasko, Avon, CT (US); Frank Higgins, Burlington, CT (US); HanJong Kim, New Britain, CT (US)

(73) Assignee: Otis Elevator Company, Farmington, CT (US)

( * ) Notice: Subject to any disclaimer, the term of this patent is extended or adjusted under 35 U.S.C. 154(b) by 432 days.

(21) Appl. No.: 12/084,867

(22) PCT Filed: Nov. 23, 2005

(86) PCT No.: PCT/US2005/042833

§ 371 (c)(1),
(2), (4) Date: Jul. 30, 2009

(87) PCT Pub. No.: WO2007/061419

PCT Pub. Date: May 31, 2007

(65) Prior Publication Data

US 2009/0301819 A1 Dec. 10, 2009

(51) Int. Cl.
*B66B 1/06* (2006.01)

(52) U.S. Cl. ..... 187/290; 187/393

(58) Field of Classification Search ..... 187/277, 187/289, 290, 293, 296, 297, 391–393; 318/799–815, 376

See application file for complete search history.

(56) References Cited

U.S. PATENT DOCUMENTS

| | | | | |
|---|---|---|---|---|
| 4,902,954 | A | 2/1990 | Oshima et al. | |
| 5,229,558 | A | 7/1993 | Hakala | |
| 5,712,456 | A * | 1/1998 | McCarthy et al. | 187/290 |
| 6,315,081 | B1 * | 11/2001 | Yeo | 187/290 |
| 6,474,447 | B2 * | 11/2002 | Tajima et al. | 187/290 |
| 6,522,099 | B2 | 2/2003 | Tominaga et al. | |
| 6,732,838 | B1 * | 5/2004 | Okada et al. | 187/290 |
| 6,742,630 | B2 | 6/2004 | Eilinger | |
| 7,106,023 | B2 * | 9/2006 | Ota et al. | 318/803 |
| 7,681,694 | B2 * | 3/2010 | Aulanko et al. | 187/290 |
| 2001/0008195 | A1 * | 7/2001 | Tajima et al. | 187/290 |

(Continued)

FOREIGN PATENT DOCUMENTS

EP 0426056 A2 5/1991

(Continued)

OTHER PUBLICATIONS

China Office Action, Apr. 22, 2010, 13 pages.

(Continued)

*Primary Examiner* — Anthony Salata
(74) *Attorney, Agent, or Firm* — Kiney & Lange, P.A.

(57) ABSTRACT

A hoist motor (12) for an elevator (14) is continuously driven from an irregular power supply (16). A regenerative drive (10) delivers power between the power supply (16) and the hoist motor (12). A controller (11) measures a power supply voltage in response to a detected change in the power supply voltage and controls the regenerative drive (10) to adjust a nominal motion profile of the elevator (14) in proportion with an adjustment ratio of the measured power supply voltage to a normal power supply voltage.

20 Claims, 3 Drawing Sheets

U.S. PATENT DOCUMENTS

| | | | | |
|---|---|---|---|---|
| 2005/0006182 | A1 | 1/2005 | Hall et al. | |
| 2007/0084673 | A1* | 4/2007 | Smith et al. | 187/290 |
| 2010/0006378 | A1* | 1/2010 | Blasko | 187/290 |
| 2010/0044160 | A1* | 2/2010 | Agirman et al. | 187/290 |
| 2010/0065380 | A1* | 3/2010 | Chen et al. | 187/290 |
| 2011/0226559 | A1* | 9/2011 | Chen et al. | 187/290 |

FOREIGN PATENT DOCUMENTS

| | | | |
|---|---|---|---|
| GB | 2168829 | A | 6/1986 |
| JP | 6077624 | | 5/1985 |
| JP | 6422774 | | 1/1989 |
| JP | 3074198 | A | 3/1991 |
| JP | 3198691 | A | 8/1991 |
| JP | 11299290 | A | 10/1999 |
| JP | 2001171920 | A | 6/2001 |

OTHER PUBLICATIONS

Official Search Report of the Patent Cooperation Treaty in counterpart foreign Application No. PCT/US2005/042833 filed Nov. 23, 2005.

Korean Office Action, Mar. 25, 2010, 4 pages.

European Patent Office, Extended European Search Report, Oct. 5, 2011, 7 pages.

Japanese Patent Office, Office Action with English Translation, Oct. 18, 2011, 5 pages.

* cited by examiner

ELEVATOR MOTOR DRIVE TOLERANT OF AN IRREGULAR POWER SOURCE

BACKGROUND OF THE INVENTION

The present invention relates to the field of elevator systems. In particular, the present invention relates to a power system for driving an elevator hoist motor from an irregular power source.

A regenerative drive for an elevator hoist motor typically includes a converter connected to an inverter via a DC bus. The inverter is connected to the hoist motor and the converter is connected to an AC power supply, such as from a power utility. When the elevator hoist motor is motoring, power from the AC power supply powers the converter, which converts the AC power to DC power for the DC bus. The inverter then converts the DC power on the DC bus to AC power for driving the hoist motor. In regenerative mode, the load in the elevator drives the motor so it generates AC power as a generator. The inverter converts the AC power from the hoist motor to DC power on the DC bus, which the converter then converts back to AC power for delivery to the AC power supply.

The drive is typically designed to operate over a specific input voltage range from the AC power supply. This range is commonly specified as a nominal operating voltage with a tolerance band (e.g., 480 $V_{AC}$±10%). Thus, the components of the drive have voltage and current ratings that allow the drive to continuously operate while the AC power supply remains within the designed input voltage range. However, in certain markets the utility network is less reliable, where persistent utility voltage sags or brownout conditions (i.e., voltage conditions below the tolerance band of the drive) are prevalent. When utility voltage sags occur, the drive draws more current from the AC power supply to maintain uniform power to the hoist motor. In conventional systems, when excess current is being drawn from the AC power supply, the drive will shut down to avoid damaging the components of the drive. As a result, elevator service is unavailable until the AC power supply returns to the nominal operating voltage range.

BRIEF SUMMARY OF THE INVENTION

The subject invention is directed to a system for continuously driving a hoist motor for an elevator from an irregular power supply. The system includes a regenerative drive for delivering power between the power supply and the hoist motor. A controller measures a power supply voltage in response to a detected change in the power supply voltage and controls the regenerative drive to adjust a nominal motion profile of the elevator in proportion with an adjustment ratio of the measured power supply voltage to a normal power supply voltage.

DETAILED DESCRIPTION

Figure 1:
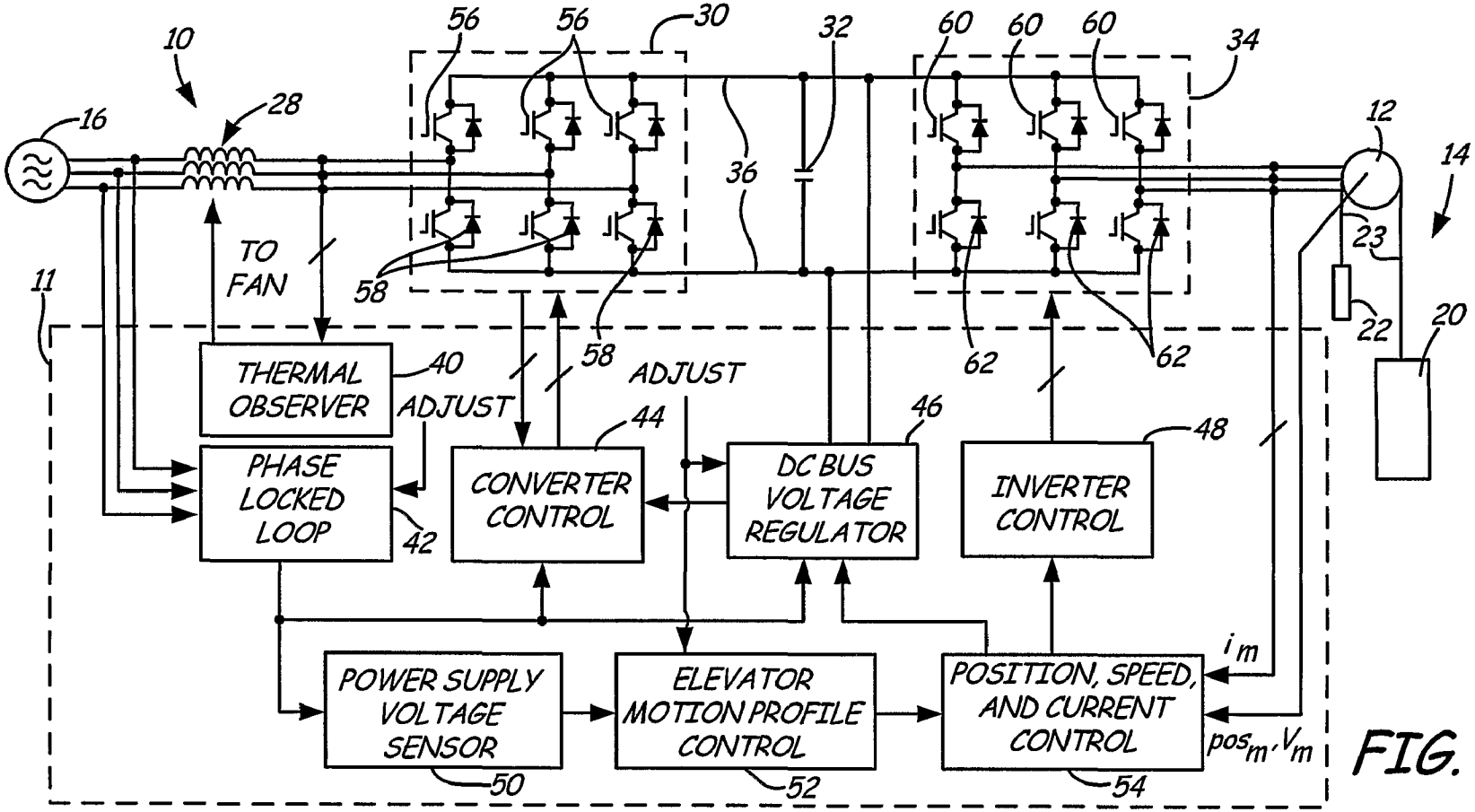
FIG. 1 is a schematic view of a power system including a controller for driving an elevator hoist motor from an irregular power supply according to an embodiment of the present invention.

FIG. 1 is a schematic view of a power system 10 including a controller 11 for driving hoist motor 12 of elevator 14 from power supply 16 according to an embodiment of the present invention. Elevator 14 includes elevator cab 20 and counterweight 22 that are connected through roping 23 to hoist motor 12. Power supply 16 may be electricity supplied from an electrical utility, such as from a commercial power source. In certain markets the utility network is less reliable, where persistent utility voltage sags or brownout conditions (i.e., voltage conditions below the tolerance band of the drive) are prevalent. Power system 10 according to the present invention allows for continuous operation of hoist motor 12 from power supply 16 during these periods of irregularity.

Power system 10 includes controller 11, line reactors 28, power converter 30, smoothing capacitor 32, and power inverter 34. Power converter 30 and power inverter 34 are connected by DC power bus 36. Smoothing capacitors 32 is connected across DC power bus 36. Controller 11 includes thermal observer 40, phase locked loop 42, converter control 44, DC bus voltage regulator 46, inverter control 48, power supply voltage sensor 50, elevator motion profile control 52, and position, speed, and current control 54. In one embodiment, controller 11 is a digital signal processor (DSP), and each of the components of controller 11 are functional blocks that are implemented in software executed by controller 11.

Thermal observer 40 is connected between line reactors 28 and power converter 30, and provides a fan control signal as its output. Phase locked loop 42 receives the three-phase signal from power supply 16 as an input, and provides an output to converter control 44, DC bus voltage regulator 46, and power supply voltage sensor 50. Converter control 44 also receives an input from DC bus voltage regulator and provides an output to power converter 30. Power supply voltage sensor 50 provides an output to elevator motion profile control 52, which in turn provides an output to position, speed, and current control 54. DC bus voltage regulator 46 receives signals from phase locked loop 42 and position, speed, and current control 54, and monitors the voltage across DC power bus 36. Inverter control 48 also receives a signal from position, speed, and current control 54 and provides a control output to power inverter 34.

Power supply 16, which is a three-phase AC power supply from the commercial power source, provides electrical power to power converter 30. Power converter 30 is a three-phase power inverter that is operable to convert three-phase AC power from power supply 16 to DC power. In one embodiment, power converter 30 comprises a plurality of power transistor circuits including parallel-connected transistors 56 and diodes 58. Each transistor 56 may be, for example, an insulated gate bipolar transistor (IGBT). The controlled electrode (i.e., gate or base) of each transistor 56 is connected to converter control 44. Converter control 44 controls the power transistor circuits to rectify the three-phase AC power from power supply 16 to DC output power. The DC output power is provided by power converter 30 on DC power bus 36. Smoothing capacitor 32 smoothes the rectified power provided by power converter 30 on DC power bus 36. It should be noted that while power supply 16 is shown as a three-phase AC power supply, power system 10 may be adapted to receive power from any type of power source, including a single phase AC power source and a DC power source.

The power transistor circuits of power converter 30 also allow power on DC power bus 36 to be inverted and provided to power supply 16. In one embodiment, controller 11 employs pulse width modulation (PWM) to produce gating pulses so as to periodically switch the transistors 56 of power converter 30 to provide a three-phase AC power signal to power supply 16. This regenerative configuration reduces the demand on power supply 16. Line reactors 28 are connected between power supply 16 and power converter 30 to control the current passing between power supply 16 and power converter 30. In another embodiment, power converter 30 comprises a three-phase diode bridge rectifier.

Power inverter 34 is a three-phase power inverter that is operable to invert DC power from DC power bus 36 to three-phase AC power. Power inverter 26 comprises a plurality of power transistor circuits including parallel-connected transistors 60 and diodes 62. Each transistor 60 may be, for example, an insulated gate bipolar transistor (IGBT). In one embodiment, the controlled electrode (i.e., gate or base) of each transistor 60 is controlled by inverter control 48 to invert the DC power on DC power bus 36 to three-phase AC output power. The three-phase AC power at the outputs of power inverter 34 is provided to hoist motor 12. In one embodiment, inverter control 48 employs PWM to produce gating pulses to periodically switch transistors 60 of power inverter 34 to provide a three-phase AC power signal to hoist motor 12. Inverter control 48 may vary the speed and direction of movement of elevator 14 by adjusting the frequency and magnitude of the gating pulses to transistors 60.

In addition, the power transistor circuits of power inverter 34 are operable to rectify power that is generated when elevator 14 drives hoist motor 12. For example, if hoist motor 12 is generating power, inverter control 34 deactivates transistors 60 in power inverter 34 to allow the generated power to be rectified by diodes 62 and provided to DC power bus 36. Smoothing capacitor 32 smoothes the rectified power provided by power inverter 34 on DC power bus 36.

Hoist motor 12 controls the speed and direction of movement between elevator cab 20 and counterweight 22. The power required to drive hoist motor 12 varies with the acceleration and direction of elevator 14, as well as the load in elevator cab 20. For example, if elevator 14 is being accelerated, run up with a load greater than the weight of counterweight 22 (i.e., heavy load), or run down with a load less than the weight of counterweight 22 (i.e., light load), a maximal amount of power is required to drive hoist motor 12. If elevator 14 is leveling or running at a fixed speed with a balanced load, it may be using a lesser amount of power. If elevator 14 is being decelerated, running down with a heavy load, or running up with a light load, elevator 14 drives hoist motor 12. In this case, hoist motor 12 generates three-phase AC power that is converted to DC power by power inverter 34 under the control of inverter control 30. The converted DC power is accumulated on DC power bus 36.

In accordance with the present invention, controller 11 monitors power supply 16 for changes in its voltage level and controls power system 10 to continuously operate hoist motor 12 through a change in the voltage of power supply 16. The three-phase output of power supply 16 is provided to phase locked loop 42. Phase locked loop 42 provides the phase and the magnitude of power supply 16 to converter control 44, DC bus voltage regulator 46, and power supply voltage sensor 50. Power supply voltage sensor 50 continuously monitors the voltage magnitude of power supply 16 and generates a signal when the voltage of power supply 16 changes. For example, power supply voltage sensor 50 may generate a signal when the power supply voltage sags outside of the tolerance band (e.g., 10% below the nominal voltage) of power system 10. This signal, which includes information about the new voltage level of power supply 16, is provided to elevator motion profile control 52.

Elevator motion profile control 52 generates a signal that is used to control the motion of elevator 14. In particular, automatic elevator operation involves the control of the velocity of elevator 12 during an elevator trip. The time change in velocity for a complete trip is termed the "motion profile" of elevator 14. Thus, elevator motion profile control 52 generates an elevator motion profile that sets the maximum acceleration, the maximum steady state speed, and the maximum deceleration of elevator 14. The particular motion profile and motion parameters generated by elevator motion profile control 52 represent a compromise between the desire for "maximum" speed and the need to maintain acceptable levels of comfort for the passengers.

In order to allow power system 10 to continuously drive hoist motor 12 when the voltage of power supply 16 strays outside of the tolerance band of power system 10, elevator motion profile control 52 adjusts the elevator motion profile based on the change in the voltage of power supply 16. More specifically, when the voltage of power supply 16 sags, power system 10 would normally draw more current from power supply 16 if the elevator motion profile remained unchanged. In order to maintain the current drawn from power supply 16 within the current rating of the components of power system 10, elevator motion profile control 52 adjusts the elevator motion profile in proportion to the change in the power supply voltage. Thus, the normal acceleration, steady state speed, and deceleration of the elevator motion profile are adjusted by the ratio of the measured voltage of power supply 16 to the nominal voltage of power supply 16. An adjust signal is provided to elevator motion profile control 52 related to this adjustment ratio. In one embodiment, power system 10 adjusts the elevator motion profile when the voltage of power supply 10 sags at least about 15% below the nominal power supply voltage. The motion profile adjustment may be performed a plurality of times depending on the severity and length of the voltage sag. When the voltage of power supply 16 returns to the nominal operating range (e.g., 480 $V_{AC}$±10%), elevator motion profile control 52 adjusts the elevator motion profile for normal operating conditions.

In addition, when the voltage of power supply 16 sags below a threshold voltage that would make further operation impractical (e.g., 30% below the nominal power supply voltage), elevator motion profile control 52 generates a motion profile that reduces the speed, acceleration, and deceleration to zero. When this motion profile is generated, power system 10 operates hoist motor 12 until all active elevator runs are completed, and ignores any further dispatch requests until the voltage of power supply 16 returns to nominal operating range.

The motion profile output of elevator motion profile control 52 is provided to position, speed, and current control 54. The motion profile includes reference signals related to the adjusted speed, position, and motor current for hoist motor 12 that are in accordance with the adjusted motion profile. These signals are compared with actual feedback values of the motor position ($pos_m$), motor speed ($v_m$), and motor current ($I_m$) by position, speed, and current control 54 to determine an error signal related to the difference between the actual operating parameters of hoist motor 12 and the target operating parameters of the adjusted motion profile. For example, position, speed, and current control 54 may include proportional and integral amplifiers to provide determine this error signal from the actual and desired adjusted motion parameters. The error signal is provided by position, speed, and current control 54 to inverter control 48 and DC bus voltage regulator 46.

Based on the error signal from position, speed, and current control 54, inverter control 48 calculates signals to be provided to power inverter 34 to drive hoist motor 12 pursuant to the motion profile when hoist motor 12 is motoring. As described above, inverter control 48 may employ PWM to produce gating pulses to periodically switch transistors 60 of power inverter 34 to provide a three-phase AC power signal to hoist motor 12. Inverter control 48 may vary the speed and direction of movement of elevator 14 by adjusting the frequency and magnitude of the gating pulses to transistors 60. Thus, in the event of voltage sag when hoist motor 12 is motoring, inverter control 48 changes the PWM gating signals to transistors 60 so as to reduce the speed of elevator 14 in proportion to the reduction in power supply voltage.

Figure 2:
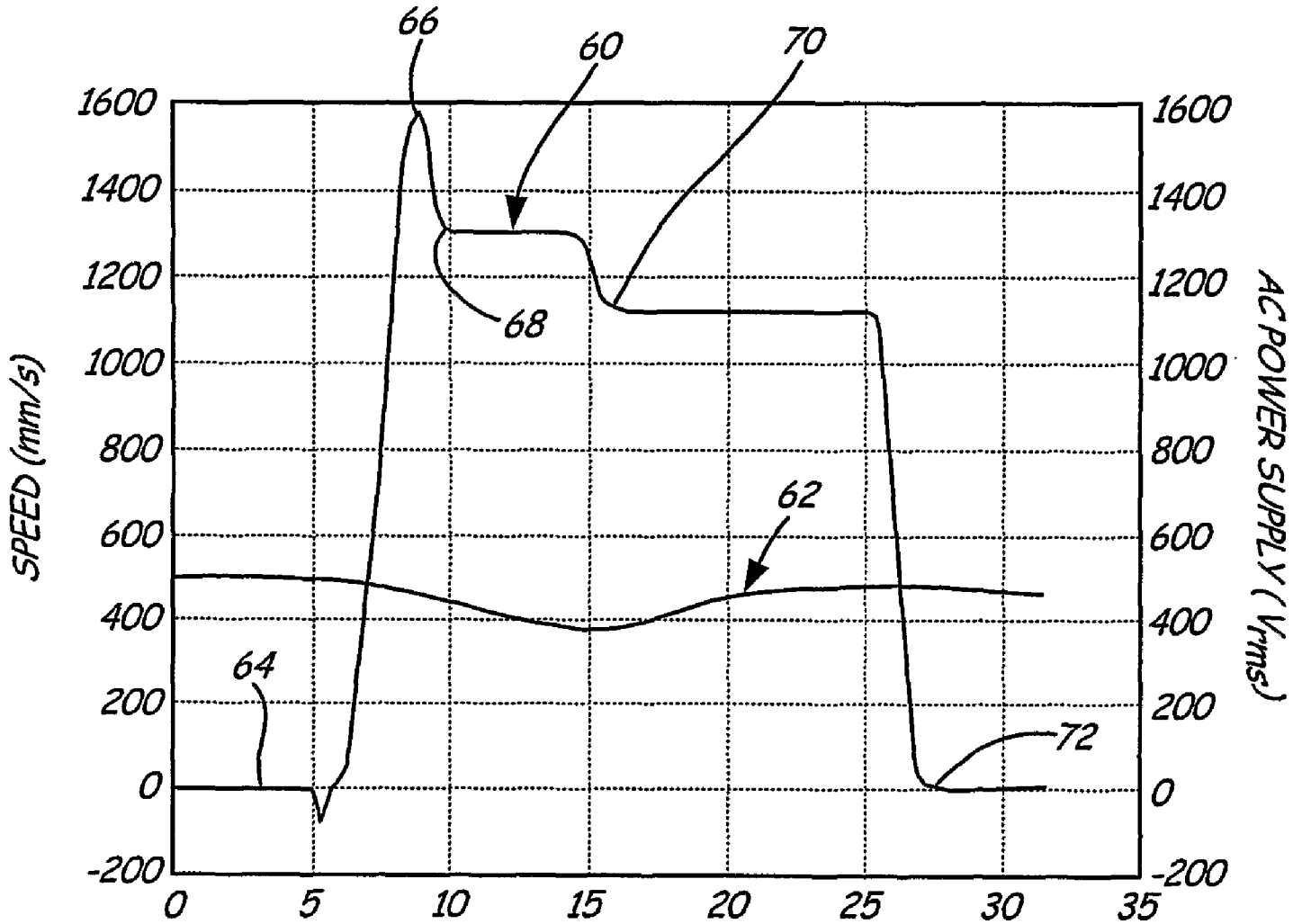
FIG. 2 is a graph showing an adjustment in the speed of the elevator hoist motor according to the present invention in response to a sag in the power supply voltage.

FIG. 2 illustrates an adjustment in the speed of elevator hoist motor 12 (line 60) in response to a sag in the voltage of power supply 16 (line 62). At time 64, elevator 14 is not being run and the speed of the elevator 14 is zero. As elevator 14 begins a run, the speed of elevator 14 increases up to a steady state speed established by the active elevator motion profile (time 66). As the voltage from power supply 16 begins to sag (line 62), the speed of elevator 14 is adjusted in proportion to the decrease in the voltage from power supply 16 (time 68). As the voltage from power supply 16 continues to sag further, the speed of elevator is again reduced in proportion to the decrease in power supply voltage (time 70). These changes may occur during a run, so the speed of elevator 14 is reduced so as to not minimize the effect on the passengers. When power supply 16 has returned to its nominal voltage, the motion profile of hoist motor remains the same until the run has completed, at which point the speed of the elevator drops to zero again (time 72).

Referring back to FIG. 1, DC bus voltage regulator 46 controls the voltage across DC power bus 36. In regenerative drives with active line converters such as power converter 30, DC power bus 36 is controlled to a fixed voltage independent of the voltage of power supply 16. The voltage across DC power bus 36 is typically fixed higher than the voltage of power supply 16 to allow sufficient margin for smoothing capacitor 32 and transistors 56 of power converter 30. In this way, power converter 30 is operated not only to convert AC power from power supply 16 to DC power, but also to control AC current between power supply 16 and power converter 30.

When the speed of hoist motor 12 is reduced due to voltage sag in power supply 16, the voltage across DC power bus 36 must accordingly be reduced. If the same voltage were maintained across DC power bus 36, the difference in the voltage across DC power bus 36 and the voltage from power supply 16 would result in switching losses in power converter 30 and ripple current in line reactors 28. Thus, outputs from phase locked loop 42 and position, speed, and current control 54 are provided to DC bus voltage regulator 46. In addition, an adjust signal is provided to phase locked loop 42 and DC bus voltage regulator 46 to adjust the control gains of DC bus voltage regulator 46 and phase locked loop 42 by the adjustment ratio of the reduced operating voltage of power supply 16 and the nominal operating voltage of power supply 16. Based on these signals, DC bus voltage regulator 46 adjusts the voltage maintained across DC power bus 36 in proportion to the decrease in speed of hoist motor 12. When the voltage of power supply 16 returns to the nominal operating range, the voltage across DC power bus 36 is returned to the normal maintained voltage.

Figure 3:
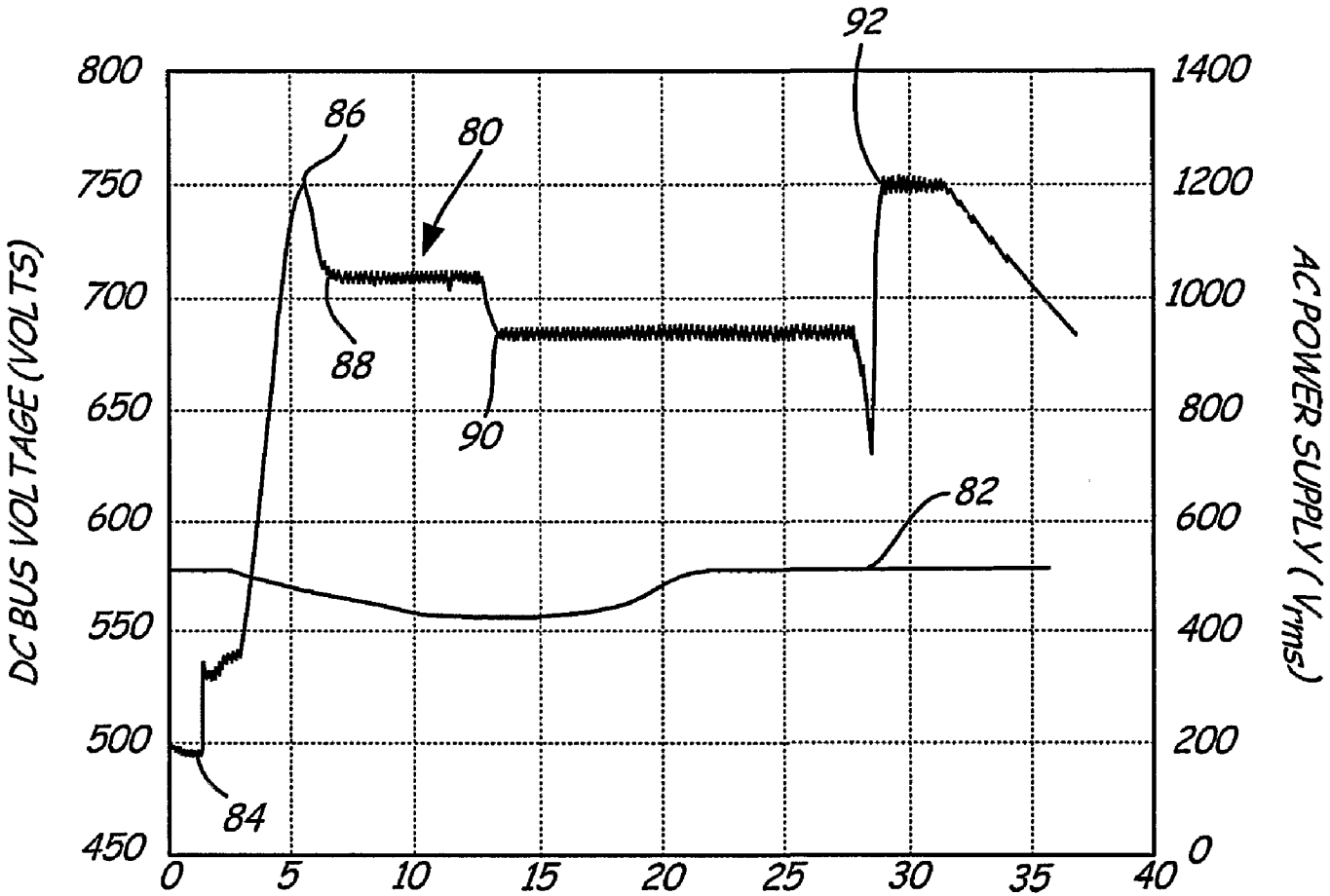
FIG. 3 is a graph showing an adjustment in the power bus voltage proportionate to a speed adjustment in the elevator hoist motor in response to a sag in the power supply voltage.

FIG. 3 illustrates the adjustment in the voltage across DC power bus 36 (line 80) proportionate to the speed adjustment in the elevator hoist motor 12 in response to a sag in the power supply voltage (line 82). At time 84, DC power bus 36 is maintained at a lower voltage near the voltage of the rectified voltage from power supply 16 because there are no control signals being provided to power converter 30 (i.e., elevator 14 is not being run). As elevator 14 begins a run, the bus voltage is ramped up to its nominal maintained voltage (time 86), which in this case is 750 $V_{DC}$. As the voltage from power supply 16 begins to sag (line 82), the speed of hoist motor 12 is adjusted, and the power on DC power bus 36 is proportionately adjusted with the speed reduction of hoist motor 12 to a first reduced level (time 88). As the voltage from power supply 16 continues to sag further, the speed of hoist motor 12 is again adjusted, and the power on DC power bus 36 is again proportionately adjusted with the speed reduction of hoist motor 12 to a second reduced level (time 90). When power supply 16 has returned to its nominal voltage, the motion profile of hoist motor 12 is returned to normal, and the voltage across DC power bus 36 is accordingly returned its nominal maintained voltage (time 92).

In addition to controlling the voltage across DC power bus 36, DC bus voltage regulator 46 provides a signal to converter control 44 related to the proportionate change in voltage across DC power bus 36. Converter control 44 also receives a signal from phase locked loop 42 related to the magnitude of the voltage of power supply 16 and a current feed forward signal from the connection between line reactors 28 and power converter 30. With these inputs, converter control 44 calculates signals to be provided to power converter 30 to rectify power from power supply 16. As described above, converter control 44 may employ PWM to produce gating pulses to periodically switch transistors 56 of power converter 30 to rectify the three-phase AC power signal from power supply 16 to DC power for DC power bus 36. In addition, converter control 44 regulates the current through line reactors 28 by comparing the signal from DC bus voltage regulator 46 and comparing it to the current feed forward signal. Converter control 44 operates power converter 30 to adjust the current between line reactors 28 and power converter 30 in accordance with the reference signal.

Because power system 10 is designed to operate over prolonged runs at reduced speeds, line reactors 28 and heat sinks for power converter 30 and power inverter 34 may experience thermal overload. Thermal observer 40 monitors the temperature of line reactors 28 and uses fan control to prevent conditions like line reactor over temperature and heat sink over temperature. To accomplish this, thermal observer 40 monitors the current between line reactors 28 and power converter 30. When this current reaches a threshold level relative to the continuous rating of line reactors 28 (e.g., 90%), thermal observer 40 sends a fan control signal to run cooling fans on line reactors 28, power converter 30, and power inverter 34 at full speed. This avoids the possibility of needing to shut down power system 10 due to thermal overload.

In summary, the present invention is directed to a system for continuously driving a hoist motor for an elevator from an irregular power supply. The system includes a regenerative drive for delivering power between the power supply and the hoist motor. A controller measures a power supply voltage in response to a detected change in the power supply voltage and controls the regenerative drive to adjust a nominal motion profile of the elevator in proportion with an adjustment ratio of the measured power supply voltage to a normal power supply voltage. This allows the elevator to continuously operate when the power supply voltage sags without drawing excessive current from the power supply. As a result, damage to the components of the hoist motor drive is prevented, and the elevator operates consistently with reduced delays due to shut down of the hoist motor drive.

Although the present invention has been described with reference to examples and preferred embodiments, workers skilled in the art will recognize that changes may be made in form and detail without departing from the spirit and scope of the invention.

The invention claimed is:

1. A system for continuously driving a hoist motor for an elevator from an irregular power supply, the system comprising:

a regenerative drive for delivering power between the power supply and the hoist motor; and a controller operable to measure a power supply voltage in response to a detected change in the power supply voltage and to control the regenerative drive to adjust a nominal motion profile of the elevator in proportion with an adjustment ratio of the measured power supply voltage to a normal power supply voltage.

2. The system of claim 1, wherein the nominal motion profile comprises at least one of maximum acceleration, maximum steady state speed, and maximum deceleration of the elevator when the power supply voltage is normal.

3. The system of claim 2, and further comprising:

a sensing device for determining whether the hoist motor is motoring or generating, wherein the controller further operates the regenerative drive to adjust the motion profile of the elevator in proportion with the adjustment ratio based on whether the hoist motor is motoring or generating.

4. The system of claim 3, wherein the maximum acceleration and maximum steady state speed are adjusted proportionally with the adjustment ratio when the elevator is motoring, wherein the maximum deceleration and maximum steady state speed are adjusted proportionally with the adjustment ratio when the elevator is generating, and wherein the motion profile is not adjusted when the elevator is neither motoring nor generating.

5. The system of claim 1, wherein the regenerative drive comprises:

a converter to convert alternating current (AC) power from the power supply into direct current (DC) power;

an inverter to drive the hoist motor by converting the DC power from the converter into AC power and, when the hoist motor is generating, to convert AC power produced by the hoist motor to DC power; and a power bus connected between the converter and the inverter to receive DC power from the converter and the inverter.

6. The system of claim 5, wherein the controller controls the inverter to drive the hoist motor based on the adjusted nominal motion profile of the elevator.

7. The system of claim 5, wherein the controller further adjusts the voltage across the power bus proportionally with the adjustment ratio in response to a change in the power supply voltage.

8. The system of claim 1, and further comprising:

line reactors connected between the regenerative drive to the power supply.

9. The system of claim 8, and further comprising:

a thermal control module for operating a drive cooling fan at maximum speed when the current through the line reactors approaches a continuous current rating of the line reactors.

10. A method for continuously driving a hoist motor for an elevator from an irregular power supply comprising:

measuring a power supply voltage in response to a change in the power supply voltage;

adjusting a nominal motion profile of the elevator in proportion with an adjustment ratio of the measured power supply voltage to a normal power supply voltage to produce a new motion profile, wherein the nominal motion profile comprises at least one of maximum acceleration, maximum steady state speed, and maximum deceleration of the elevator when the power supply voltage is normal; and driving the elevator hoist motor with a drive current based on the new motion profile.

11. The method of claim 10, wherein adjusting a nominal profile of the elevator comprises determining whether the hoist motor is motoring or generating and adjusting the motion profile of the elevator in proportion with the adjustment ratio based on whether the hoist motor is motoring or generating.

12. The method of claim 11, wherein the maximum acceleration and maximum steady state speed are adjusted proportionally with the adjustment ratio when the elevator is motoring, wherein the maximum deceleration and maximum steady state speed are adjusted proportionally with the adjustment ratio when the elevator is generating, and wherein the motion profile is not adjusted when the elevator is neither motoring nor generating.

13. The method of claim 12, and further comprising:

driving the elevator hoist motor with a drive current based on the nominal motion profile when the power supply returns to a normal power supply voltage.

14. A system for controlling a regenerative drive including a converter and inverter connected by a direct current (DC) bus, the inverter connected to an elevator hoist motor and the inverter connected to an alternating current (AC) power supply via line reactors, the system comprising:

a voltage sensor for detecting a change in a power supply voltage and measuring the power supply voltage;

an elevator motion profile generator which, in response to a change in the power supply voltage, generates a new motion profile that is a nominal motion profile proportionally adjusted by an adjustment ratio of the measured power supply voltage to a normal power supply voltage;

an error correction device that receives the new motion profile and actual operating parameters of the hoist motor and produces an error signal related to a difference between the actual operating parameters and target operating parameters based on the new motion profile; and an inverter controller that receives the error signal and controls the inverter to drive the hoist motor to the target operating parameters.

15. The system of claim 14, wherein the nominal motion profile comprises at least one of maximum acceleration, maximum steady state speed, and maximum deceleration of the elevator when the power supply voltage is normal.

16. The system of claim 15, wherein the elevator motion profile generator adjusts the maximum acceleration and maximum steady state speed proportionally with the adjustment ratio when the elevator is motoring, wherein the elevator motion profile generator adjusts the maximum deceleration and maximum steady state speed proportionally with the adjustment ratio when the elevator is generating, and wherein the elevator motion profile generator does not adjust the motion profile when the elevator is neither motoring nor generating.

17. The system of claim 14, and further comprising:

a DC bus voltage regulator operable to adjust a voltage across the DC bus proportionally with the adjustment ratio in response to a change in the power supply voltage.

18. The system of claim 14, and further comprising:

a current regulator for determining a difference between the power supply voltage and a DC bus voltage and operating the converter to balance the power supply voltage and the DC bus voltage to regulate the current across the line reactors.

19. The system of claim 18, wherein the converter comprises a plurality of power transistor circuits, each power transistor circuit comprising a transistor and a diode connected in parallel, and wherein the current regulator employs pulse width modulation to produce gating pulses that periodically switch the transistors to balance the power supply voltage and the DC bus voltage.

20. The system of claim 14, wherein the inverter comprises a plurality of power transistor circuits, each power transistor circuit comprising a transistor and a diode connected in parallel, and wherein the inverter controller employs pulse width modulation to produce gating pulses to periodically switch the transistors to drive the hoist motor to the target operating parameters.

* * * * *